US006012778A

United States Patent [19]

Peterson

[11] Patent Number: 6,012,778

[45] Date of Patent: Jan. 11, 2000

[54] INFLATABLE SEAT BACK

[75] Inventor: Leroy L. Peterson, Omaha, Nebr.

[73] Assignee: Sportsstuffm Inc., Omaha, Nebr.

[21] Appl. No.: 09/104,469

[22] Filed: Jun. 25, 1998

[51] Int. Cl.[7] ..... A47C 7/02

[52] U.S. Cl. ..... 297/452.41; 441/131

[58] Field of Search ..... 297/452.41, 450.15; 5/656, 655.3, 738, 653; 441/66, 126, 127, 130, 131

[56] References Cited

U.S. PATENT DOCUMENTS

| | | | |
|---|---|---|---|
| 2,623,574 | 12/1952 | Damsch | 297/452.41 X |
| 3,581,322 | 6/1971 | Marsico | 5/738 X |
| 3,959,835 | 6/1976 | Nos | 5/738 X |
| 4,687,452 | 8/1987 | Hull | 441/131 |
| 5,020,517 | 6/1991 | Foster, Jr. et al. | 128/33 |
| 5,474,481 | 12/1995 | Ramsey | 441/131 |
| 5,560,056 | 10/1996 | Tai | 297/452.41 X |
| 5,713,773 | 2/1998 | Churchill | 441/66 |

FOREIGN PATENT DOCUMENTS

| | | | |
|---|---|---|---|
| 2108435 | 5/1983 | United Kingdom | 441/130 |

*Primary Examiner*—Peter M. Cuomo
*Assistant Examiner*—Stephen Vu
*Attorney, Agent, or Firm*—Henderson & Sturm

[57] ABSTRACT

An inflatable seat back associated with a horizontal base and including an expandable pocket with a movable seat back panel. The seat back panel is movable between a lowered position parallel to the base and a raised position perpendicular to the base. An inflatable bladder disposed within the expandable pocket is selectively inflatable to move and support the seat back at a selected angle with respect to the base. The expandable pocket includes a web section interconnecting the base and the peripheral free edge of the seat back panel. A zippered opening in the web allows access to insert or remove the inflatable bladder from the pocket. Also, a zippered closure secures the free edge of the panel to the base when the panel is in the lowered position.

19 Claims, 2 Drawing Sheets

INFLATABLE SEAT BACK

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

AUTHORIZATION PURSUANT TO 37 C.F.R. § 1.71 (d)(e)

A portion of the disclosure of this patent document, including appendices, may contain material which is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

1. Field of the Invention

The present invention relates to the field of inflatable devices, and more particulary to inflatable seat backs.

2. Description of Related Art

Inflatable seats and seat backs are known, as for example, as shown in U.S. Pat. No. 4,687,451. However, no seat backs are known that are capable of being selectively reclined from a vertical to a horizontal position. Known inflatable seat backs therefore lack versatility, which is particularly desirable in a recreational setting.

As a consequence of the foregoing situation, there has existed a longstanding need for a new and improved inflatable seat back and the provision of such a construction is a stated objective of the present invention.

BRIEF SUMMARY OF THE INVENTION

The present invention provides an inflatable seat back associated with a horizontal base and including an expandable pocket with a movable seat back panel. The seat back panel is movable between a lowered position parallel to the base and a raised position perpendicular to the base. An inflatable bladder disposed within the expandable pocket is selectively inflatable to move and support the seat back at a selected angle with respect to the base. The expandable pocket includes a web section interconnecting the base and the peripheral free edge of the seat back panel. A zippered opening in the web allows access to insert or remove the inflatable bladder from the pocket. Also, a zippered closure secures the free edge of the panel to the base when the panel is in the lowered position.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
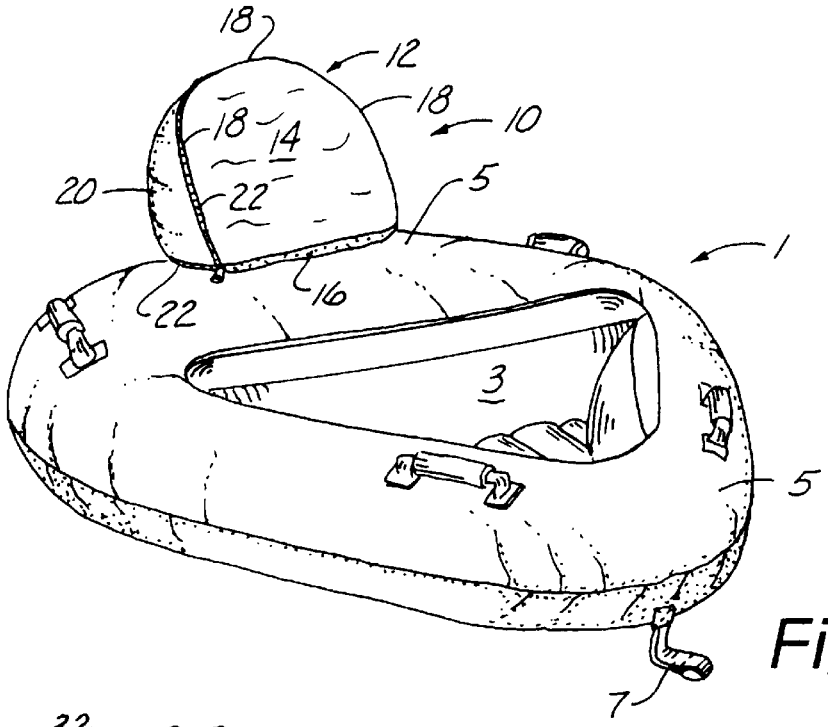
FIG. 1 is a perspective view of an inflatable seat back of the present invention shown in the raised position and attached to a single passenger towable water vehicle.

As can be seen by reference to the drawings, and in particularly to FIG. 1, the inflatable seat back 10 of the present invention is shown attached to a single passenger towage water vehicle 1. It is to be understood that the seat back 10 could be used in combination with other base components, or that multiple seat backs 10 could be used with a single base component. The water vehicle 1 includes an inflatable member 3 covered by a nylon fabric shell 5 having a towing loop 7 as generally described and shown in U.S. Pat. No. 5,006,087 to Peterson.

Figure 2:
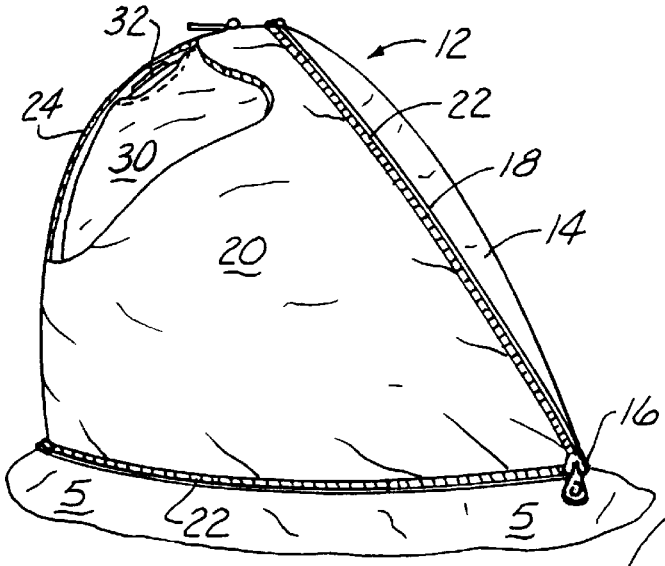
FIG. 2 is a left side partial perspective view of the inflatable seat back with a portion cut away to show the inflatable bladder in the expandable pocket.
Figure 5:
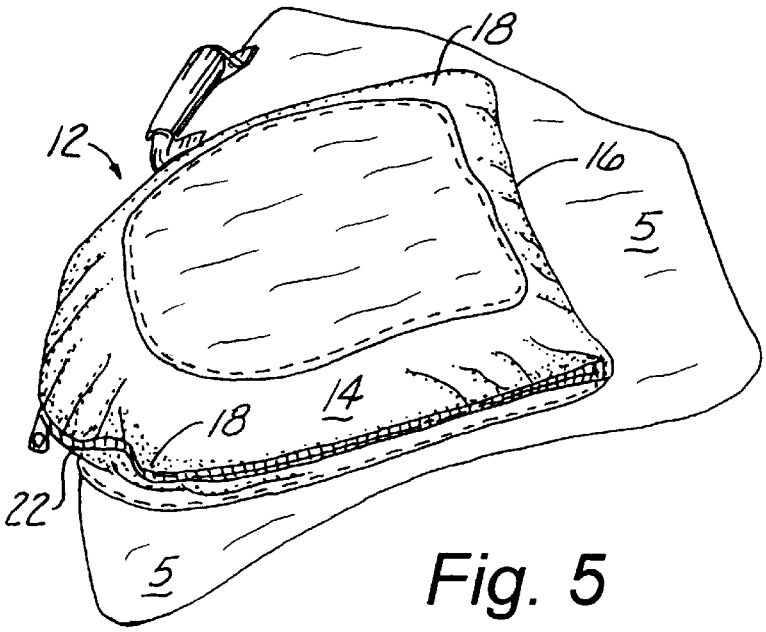
FIG. 5 is a partial perspective view showing the seat back in the lowered position.
Figure 7:
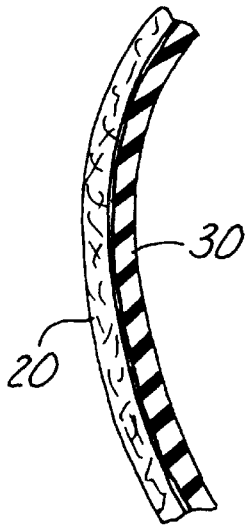
FIG. 7 is an enlarged sectional view taken along line 7—7 of FIG. 4 showing a portion of the wall of the pocket adjacent a portion of the wall of the bladder.

The nylon shell 5 supported by the inflatable member 3 forms a horizontal base to which the inflatable seat back 10 is attached. It is to be understood that the base could be any of a variety of horizontally disposed support members, and need not be inflatable. The inflatable seat back 10 includes an expandable pocket 12 formed of nylon and having a seat back panel 14 attached along its leading edge 16 to the nylon shell 5 to form a hinge connection. The peripheral free edge 18 of the seat back panel 14 defines the sides and top of the panel 14. The pocket 12 also includes a web section 20 that interconnects the peripheral free edge 18 and a section of the nylon shell base 5 disposed behind the leading edge 16 of the seat back panel 14. As best illustrated in FIGS. 2 and 5, the section of the nylon shell base 5 to which the web 20 is attached generally corresponds in shape to the shape of the peripheral edge 18 of the panel 14. A zippered closure 22 is disposed to secure the peripheral edge 18 to the nylon shell base 5.

Figure 3:
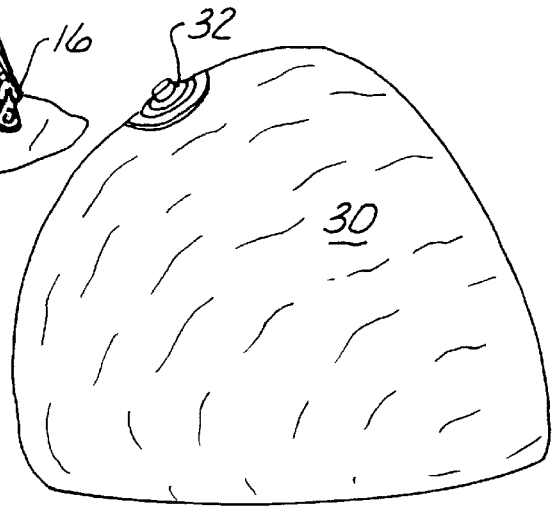
FIG. 3 is a perspective view of the inflated bladder.
Figure 4:
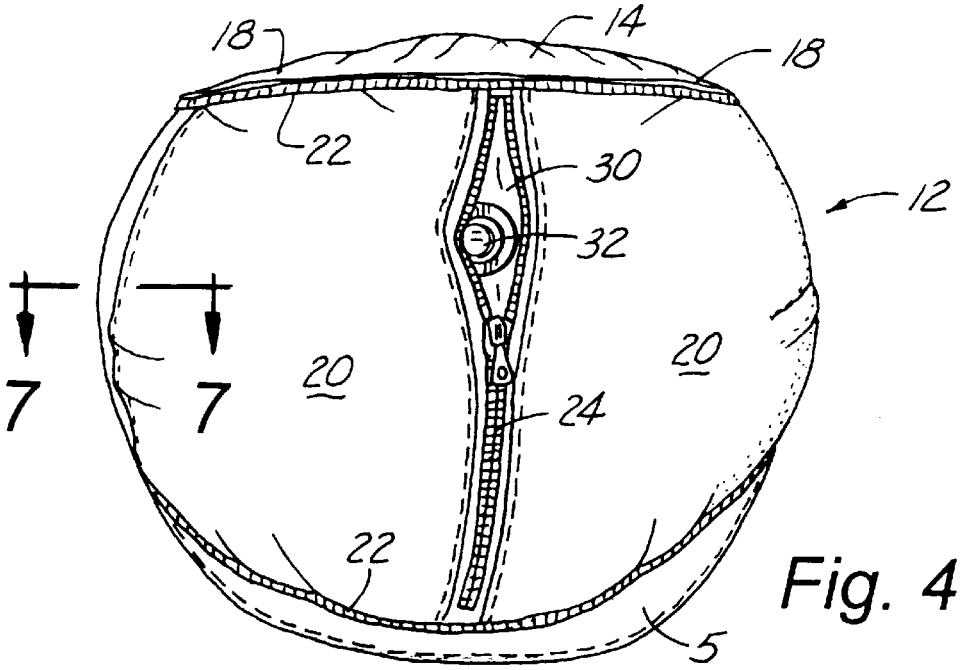
FIG. 4 is a rear partial perspective view showing the zippered access opening for the bladder.

As illustrated in FIGS. 2–4, an inflatable bladder 30 having a valve 32 is disposed within the expandable pocket 12. The bladder 30 may be inserted into or removed from the pocket 12 through the zippered access opening 24 located in the web section 20. Also, access to the valve 32 is provided by opening 24 to inflate or deflate the bladder 30 as desired.

Figure 6:
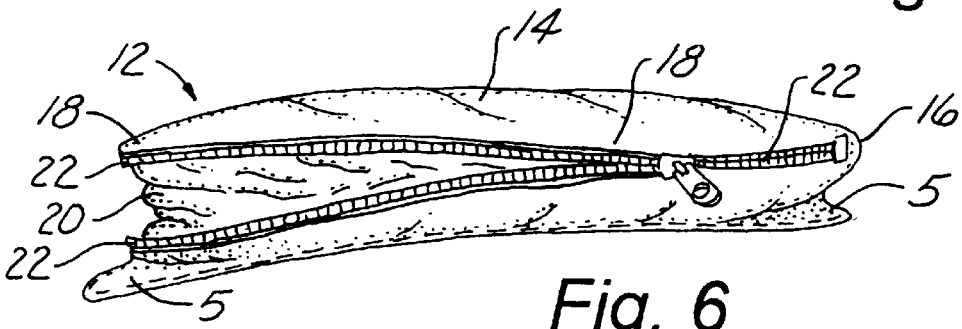
FIG. 6 is a left side partial perspective view showing the zippered closure between the seat back and the base.

In use, the bladder 30 is positioned in the expandable pocket 12 and inflated to the desired size to support the seat back panel 14 at the desired angle with respect to the base 5. The zippered access opening 24 is then closed. If it is desired to change the inclination of the panel 14, the access opening 24 is opened to expose the valve 32 (FIG. 4), and the bladder 30 is inflated or deflated as desired. If the user wishes to move the seat back panel 14 to the fully lowered position, (FIGS. 5 and 6), the bladder 30 is completely deflated, the web section 20 is tucked back, and the zipper 22 is closed to secure the seat back panel 14 in the fully lower position.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

I claim:

1. An inflatable seat back, comprising:

a horizontally disposed base;

an expandable pocket having a movable seat back panel, the panel including a leading edge attached to the base and a peripheral free edge, provided with a collapsible web section which depends downwardly from the peripheral free edge of the back panel wherein a portion of the web section is attached to the base at a location spaced from the point of attachment of the leading edge relative to the base between a fully lowered deflated position substantially parallel to the base and a fully raised inflated position substantially perpendicular to the base wherein the seat back panel is secured in the lowered position by a closure attached to the base and the peripheral free edge of the panel; and an inflatable bladder disposed within the pocket, the bladder being selectively inflatable to move and support the panel at a selected location between the fully lowered, deflated and fully raised inflated positions.

2. The seat back of claim 1 wherein the pocket web section includes a zippered access opening.

3. The seat back of claim 1 wherein the closure attached to the base and the peripheral free edge of the seat back panel is a zipper.

4. The seat back of claim 1 wherein the base includes an inflatable member covered by a fabric shell.

5. The seat back of claim 4 wherein the expandable pocket is constructed from a fabric.

6. The seat back of claim 5 wherein the expandable pocket is constructed from a nylon fabric.

7. The seat back of claim 4 wherein the fabric shell is nylon.

8. The seat back of claim 4 wherein the base forms a portion of a towable water vehicle.

9. The seat back of claim 7 wherein the expandable pocket is constructed from a nylon fabric.

10. An inflatable seat back, comprising:

a horizontally disposed base;

an expandable pocket having a movable seat back panel, the panel including a leading edge attached to the base and a peripheral free edge; provided with a collapsible web section which depends downwardly from the peripheral free edge of the back panel, wherein a portion of the web section is attached to the base at a location spaced from the point of attachment of the leading edge relative to the base, the entire panel being movable between a fully lowered deflated position substantially parallel to the base and a fully raised inflated position substantially perpendicular to the base, the seat back panel and the base being angularly disposed with respect to each other such that the angle between the seat back panel and the base member becomes progressively smaller as the seat back panel moves from the fully raised inflated position to the fully lowered deflated position; and an inflatable bladder disposed within the pocket, the bladder being selectively inflatable to move and support the panel at a selected location between the lowered and raised positions.

11. The seat back of claim 10 wherein the seat back panel is secured in the lowered position by a zippered closure attached to the base and the peripheral free edge of the panel.

12. The seat back of claim 10 wherein the base forms a portion of a towable water vehicle.

13. The seat back of claim 10 wherein the pocket web section includes a zippered access opening.

14. The seat back of claim 13 wherein the seat back panel is secured in the lowered position by a zippered closure attached to the base and the peripheral free edge of the panel.

15. The seat back of claim 10 wherein the base includes an inflatable member covered by a fabric shell.

16. The seat back of claim 15 wherein the expandable pocket is constructed from a fabric.

17. The seat back of claim 16 wherein the expandable pocket is constructed from a nylon fabric.

18. The seat back of claim 15 wherein the fabric shell is nylon.

19. The seat back of claim 18 wherein the expandable pocket is constructed from a nylon fabric.

* * * * *

UNITED STATES PATENT AND TRADEMARK OFFICE

CERTIFICATE OF CORRECTION

PATENT NO : 6,012,778

DATED : January 11, 2000

INVENTOR(S) : Leroy L. Peterson

It is certified that error appears in the above-identified patent and that said Letters Patent is hereby corrected as shown below:

Column 3, line 15 after the word "base" and before the word "between" insert –, the entire panel being movable--

Signed and Sealed this

Sixth Day of March, 2001

*Attest:*

Nicholas P. Godici

NICHOLAS P. GODICI

*Attesting Officer*

*Acting Director of the United States Patent and Trademark Office*